US006328658B1

(12) United States Patent
Gnezdilov

(10) Patent No.: US 6,328,658 B1
(45) Date of Patent: Dec. 11, 2001

(54) AMUSEMENT RIDE

(76) Inventor: Vladimir Gnezdilov, Pyatnitskoye Shossye 36, Korpus 1, Kvartira 43, Moscow, 123310 (RU)

( * ) Notice: Subject to any disclaimer, the term of this patent is extended or adjusted under 35 U.S.C. 154(b) by 0 days.

(21) Appl. No.: 09/440,994

(22) Filed: Nov. 16, 1999

(51) Int. Cl.[7] ..... A63G 1/08
(52) U.S. Cl. ..... 472/32; 472/29; 472/136
(58) Field of Search ..... 472/28, 29, 30, 472/33, 57, 136, 59, 35, 32, 44, 45; 104/127

(56) References Cited

U.S. PATENT DOCUMENTS 2,384,237 * 9/1945 Clark ..... 472/29
3,610,614 10/1971 Nishizawa .
6,161,341 * 12/2000 Anderson ..... 472/136 X

FOREIGN PATENT DOCUMENTS 5-98821 A 4/1993 (JP) .

* cited by examiner

*Primary Examiner*—Kien T. Nguyen
(74) *Attorney, Agent, or Firm*—Frishauf, Holtz, Goodman, Langer & Chick, P.C.

(57) ABSTRACT

An amusement ride is provided which includes a base, stationary elements mounted on said base, assemblies that are movable relative to said stationary elements, cabins that are fastened on said moving assemblies, and units for passengers loading, unloading and servicing that are mounted on said base. At least one of said cabins is designed as a restaurant and/or a bar, and said servicing units contain blocks for food preparation and/or storage. The amusement ride can be designed as a panoramic wheel or any other amusement device equipped with cabins that move under the action of forces applied.

23 Claims, 7 Drawing Sheets

AMUSEMENT RIDE

BACKGROUND OF THE INVENTION

1. Field of the Invention

The invention relates amusement devices which specifically provide a thrill based on a high-altitude perception, and in particular to amusement rides featuring big-sized cabins intended to be occupied simultaneously by 8–10 or more people.

2. Description of the Related Art

The current amusement rides featuring cabins which can accommodate a great number of guests at one time do not provide thrills and their amusing effect is monotonous because the guests are not organized inside the cabins. The guests lack the opportunity to enjoy the ride and the surrounding view and to have a nice meal at the same time.

It is assumed that no known amusement ride solves the task of providing an entertainment which simultaneously combines the joys of the ride itself, a panoramic view and partaking of food, drinks, etc.

SUMMARY OF THE INVENTION

It is, therefore, an object of the present invention to provide an amusement ride comprising cabins featuring tables, seats for guests, and other elements of restaurant equipment, so that guests can enjoy services as in a restaurant during the ride. The object of the present invention is to create a ride providing an entertaining effect during which guests are able to relax in the atmosphere of a restaurant and/or a bar.

Said objective is accomplished through designing at least one of the ride cabins as a restaurant and/or bar by providing servicing units that comprise blocks for preparing and/or storing food.

The moving elements and assemblies make up a panoramic wheel which can rotate continuously, with passengers loading and unloading during the wheel rotation.

The servicing units may also contain a waste bin. The waste bin can be fixed in the cabin in such a way that it can be disengaged and removed from the cabin.

To enhance the ride capacity, special guides mounted on a cabin motion section can be used to exchange the waste bin, said guides providing an opportunity to substitute an empty bin for a bin filled with waste in the course of the cabin motion. A special bin-housing module can be provided in the lower part of the cabin.

To ensure continuous motion of the cabins, one can make use of a device for food and accessories delivery which comprises a separate door aperture made in the cabins and/or a capsule for food and accessories which is delivered into the moving cabins.

The ride can feature cabins fastened on to the circumference along a driving wheel, a part of which in the plan view is located beyond the upper part of a building, e.g., on the roof.

The driving wheel may comprise an axle of rotation positioned at an angle to the horizontal plane and directed upward from the base, the axle being positioned near the angle of the building roof. To increase the thrilling effect, one can vary the angle of the axle inclination during the ride operation and the loading/unloading of guests.

To enhance the entertainment value, the cabins may be equipped with tables, seats, restaurant or bar kitchen equipment elements, and a working station for servicing personnel.

One of the cabin embodiments comprises a car and a platform pivotally fixed inside the car. Said platform supports tables, seats, restaurant or bar kitchen equipment elements, and a working station for servicing personnel positioned along the platform circumference in the central part of the platform and/or the car.

Another cabin embodiment comprises a base connected with a load-bearing element, the central part of said base supporting kitchen equipment elements, and a working station for servicing personnel, and a rotating platform with tables and seats that encompasses the central part.

BRIEF DESCRIPTION OF THE DRAWINGS

Other characteristics of the invention will become apparent in light of the following detailed description, and in light of the appended drawings in which.

DESCRIPTION OF THE PREFERRED EMBODIMENTS

FIGS. 1–5 show specific embodiments of the invention.

Figure 1:
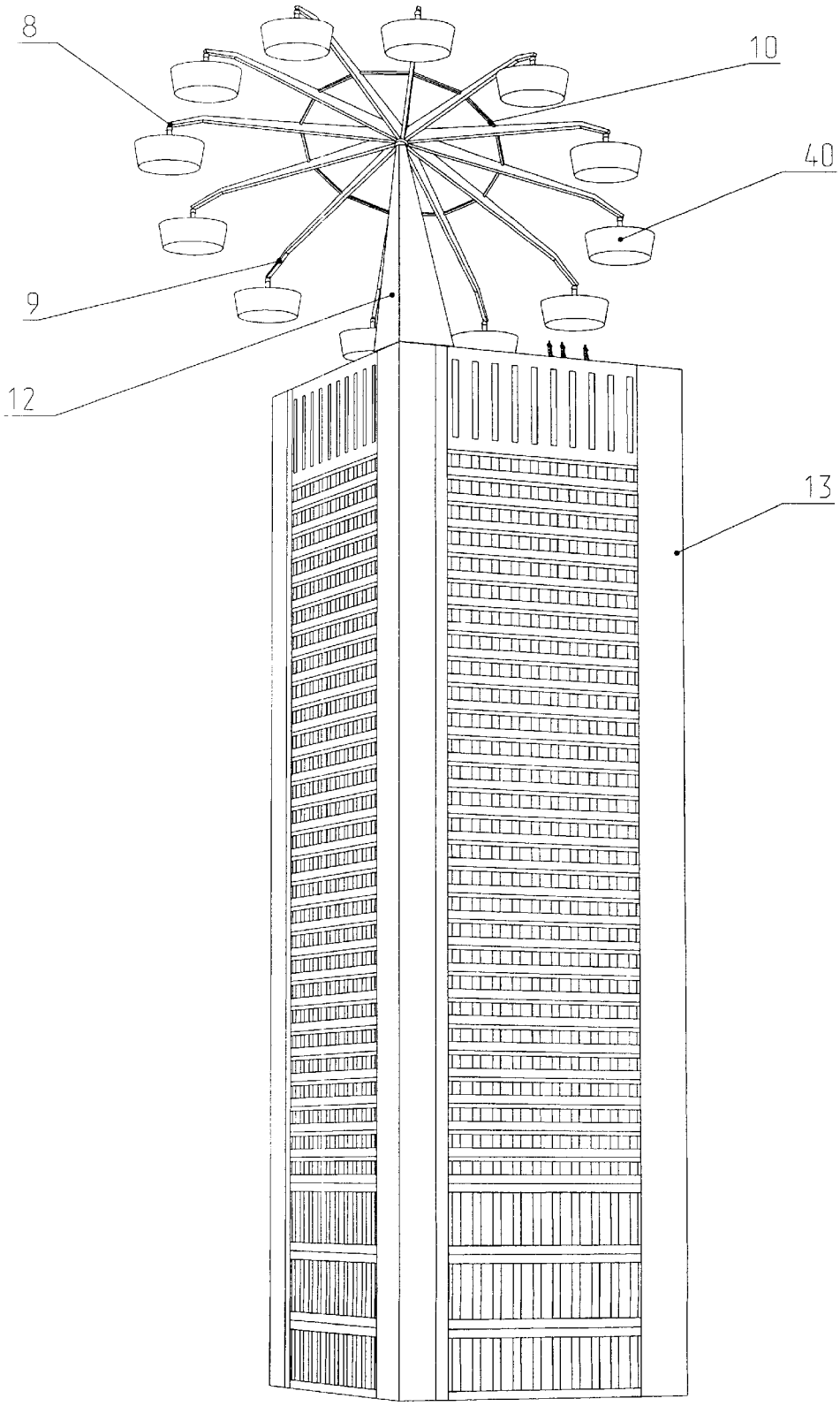
FIG. 1 is a diagrammatic view of the ride on the building.
Figure 2:
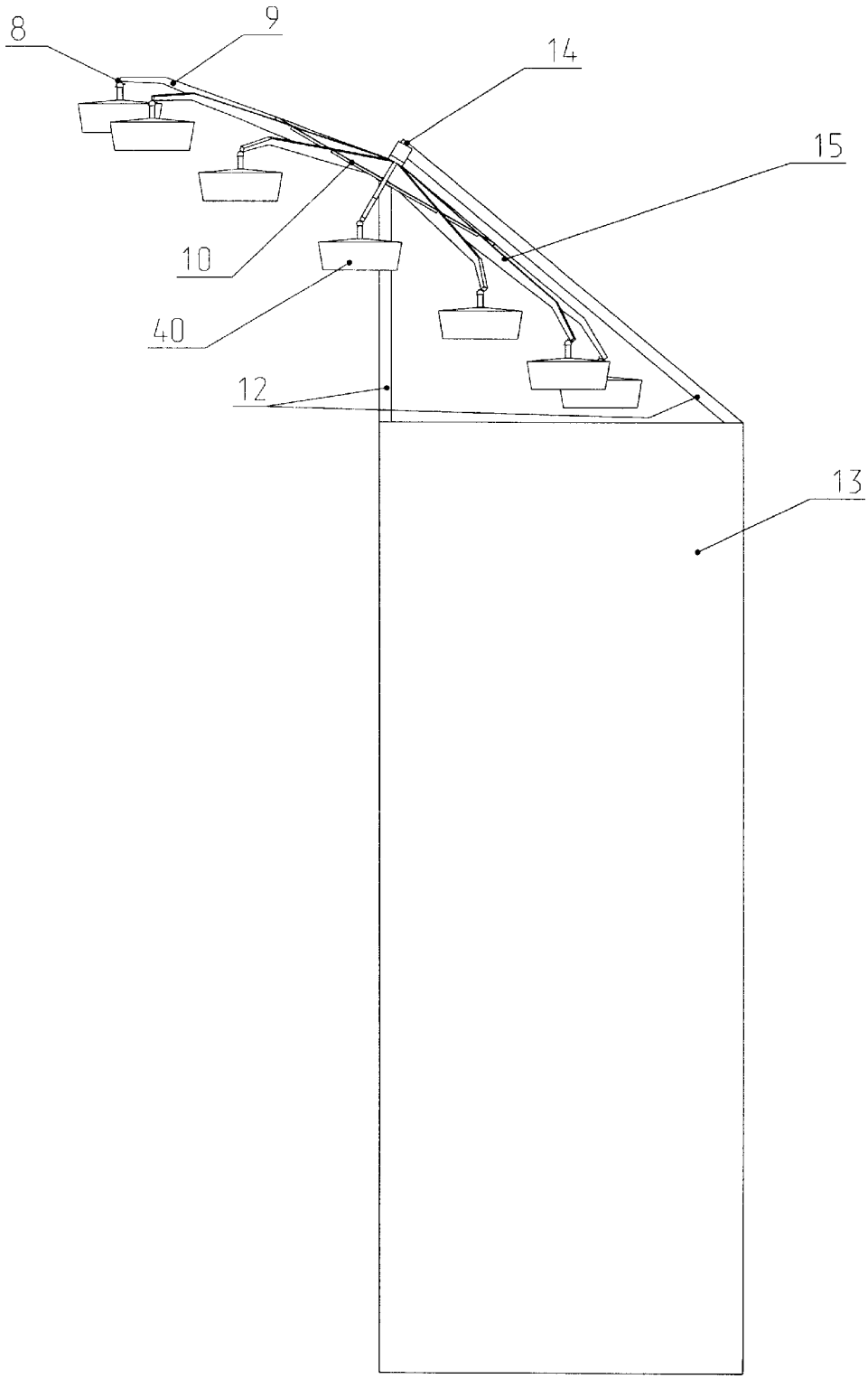
FIG. 2 shows an embodiment of FIG. 1 with an inclined driving wheel and radial elements positioned along the generators of a conical surface.
Figure 3:
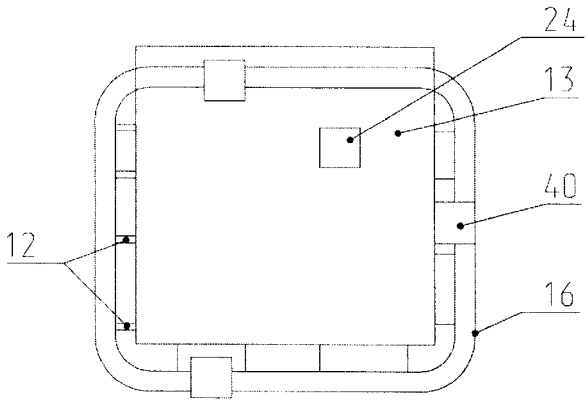
FIG. 3 shows an another embodiment of the invention on a building.
Figure 7:
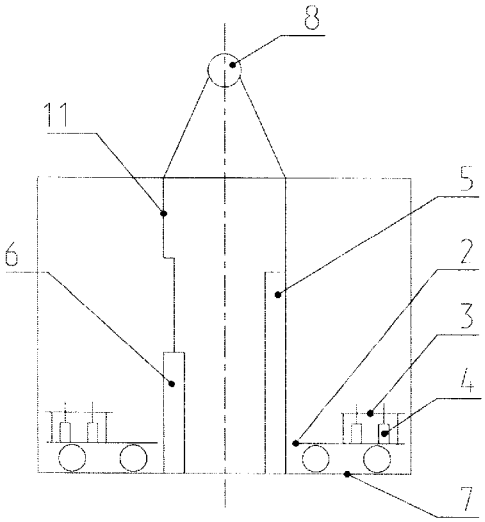
FIG. 7 shows a cabin with a circular platform.

FIGS. 1 and 2 are a diagrammatic rendering of the first embodiment of the invention, wherein the amusement ride features a driving wheel with a base 12 fastened on building 13. The ride comprises axle 14 inclined to the horizontal plane and fastened on a stationary base 12 and radial assemblies 15 which can move relative to stationary elements 12, 14. Other embodiments use a horizontal axle and an axle with an inclination angle that is changeable by means of a drive (not shown in the drawings).

Axle 14 can be positioned on the roof of a building near a corner of the building. In this manner the thrilling effect is heightened since the cabins 40 rotate partially outside the roof.

The common feature of all invention embodiments under consideration is the use of cabins 40 fastened on mobile assemblies 15. Each cabin 40, depending on the ride type, may possess certain structural features which will be discussed in detail in the description of FIGS. 7–13.

The objective of the ride is to produce an entertaining effect based on the high-altitude perception in combination with relaxation by providing one and preferably a plurality of cabins 40 equipped as a restaurant and/or a bar.

Figure 4:
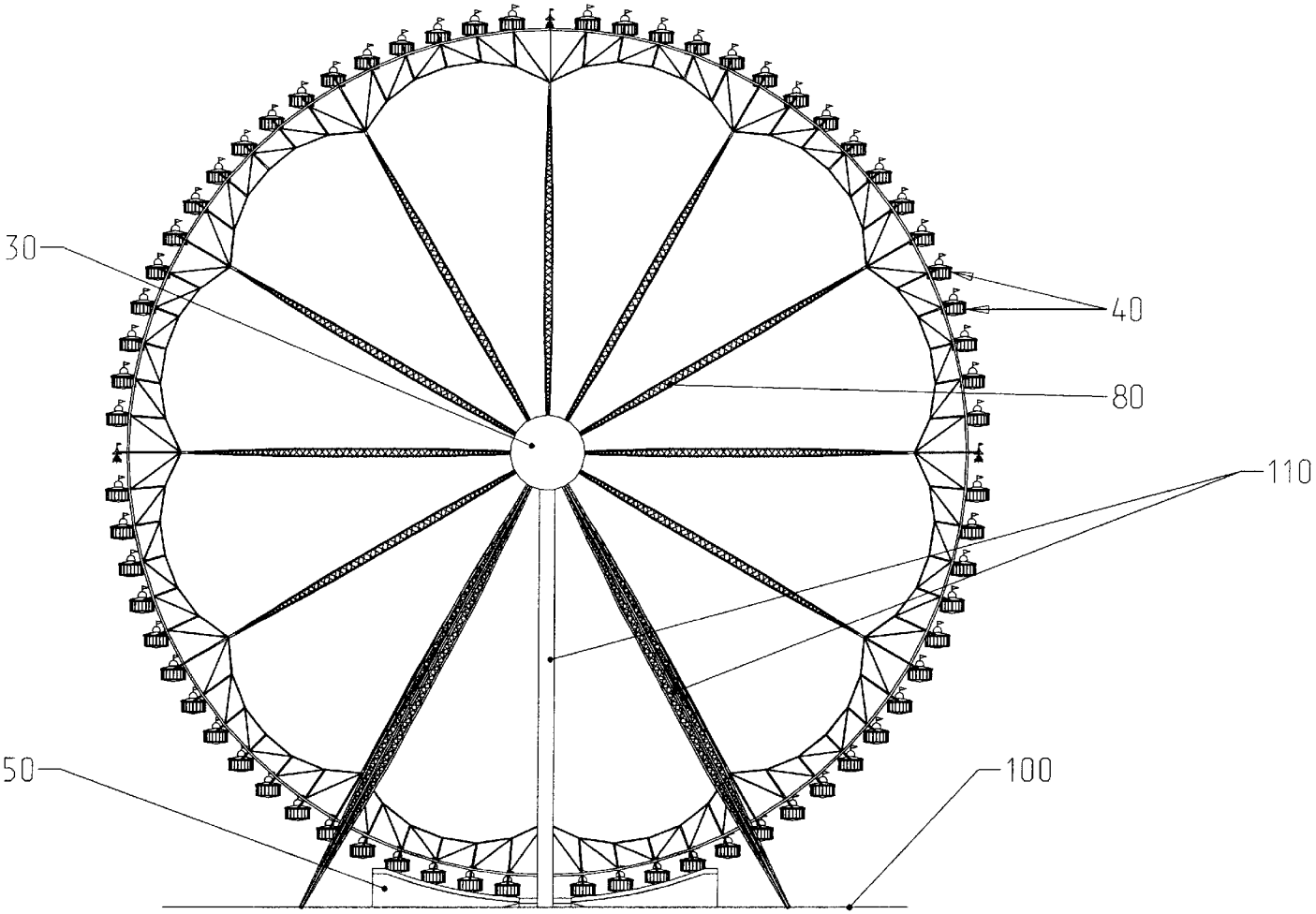
FIG. 4 is a diagrammatic front view illustrating the an embodiment using a panoramic wheel as an amusement ride.
Figure 5:
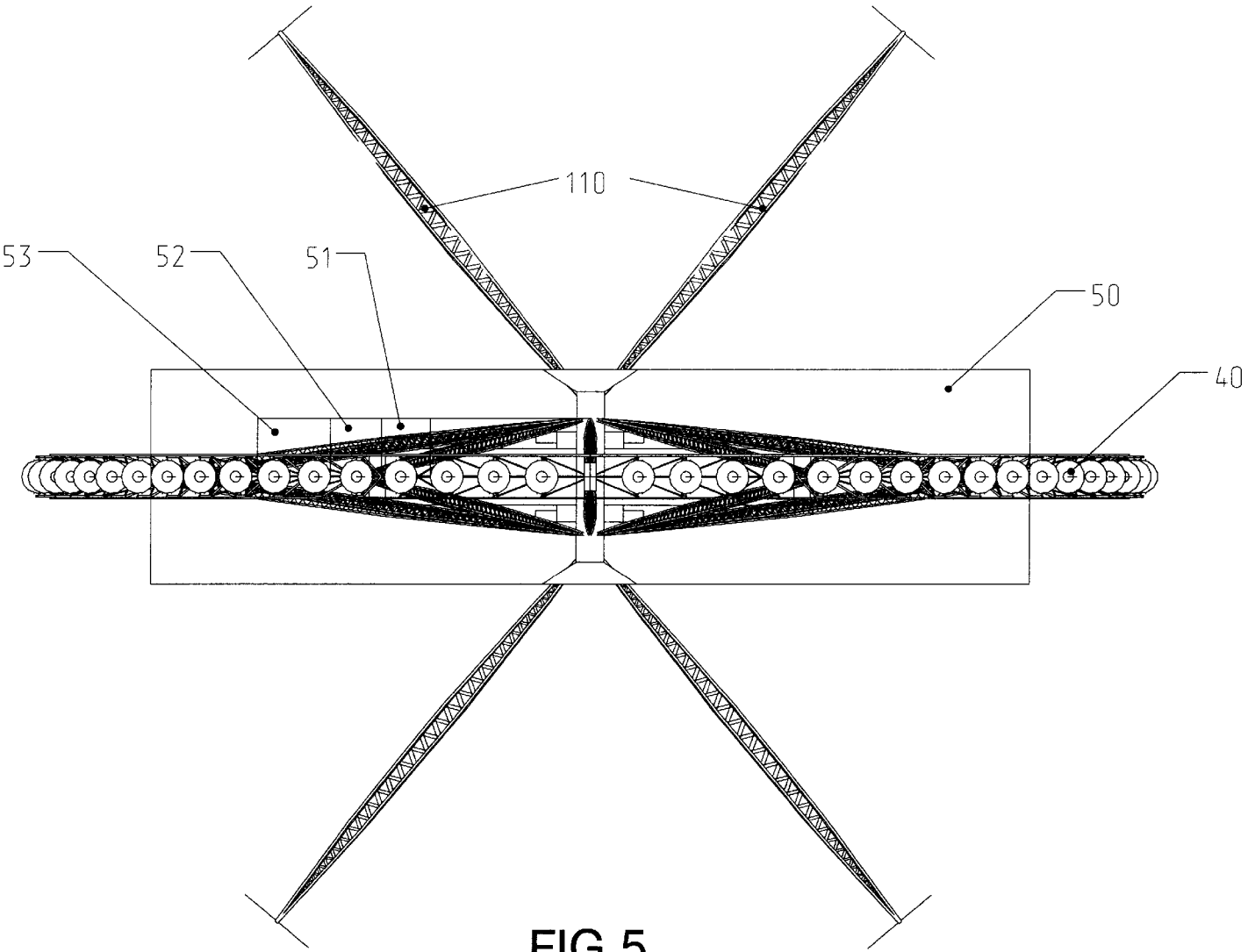
FIG. 5 is a plan view of FIG. 4.

FIGS. 4 and 5 are diagrammatic illustrations of another embodiment of the present invention, i.e., a panoramic wheel amusement ride having restaurant and/or bar units.

The ride comprises base 100, stationary support components 110 and axle 30 mounted on base 100, spokes 80 mobile in relation to said stationary components which support rim 60 to which cabins 40 are hinged. The ride is equipped with driving device 51 that is a conventional type for wheel rotation (FIG. 5), unit 50 for passenger loading and unloading, and unit 52 for passenger servicing. Units 50 and 52 are positioned on base 100. Servicing unit 52 also contains blocks 53 for preparing and/or storing food.

Figure 6:
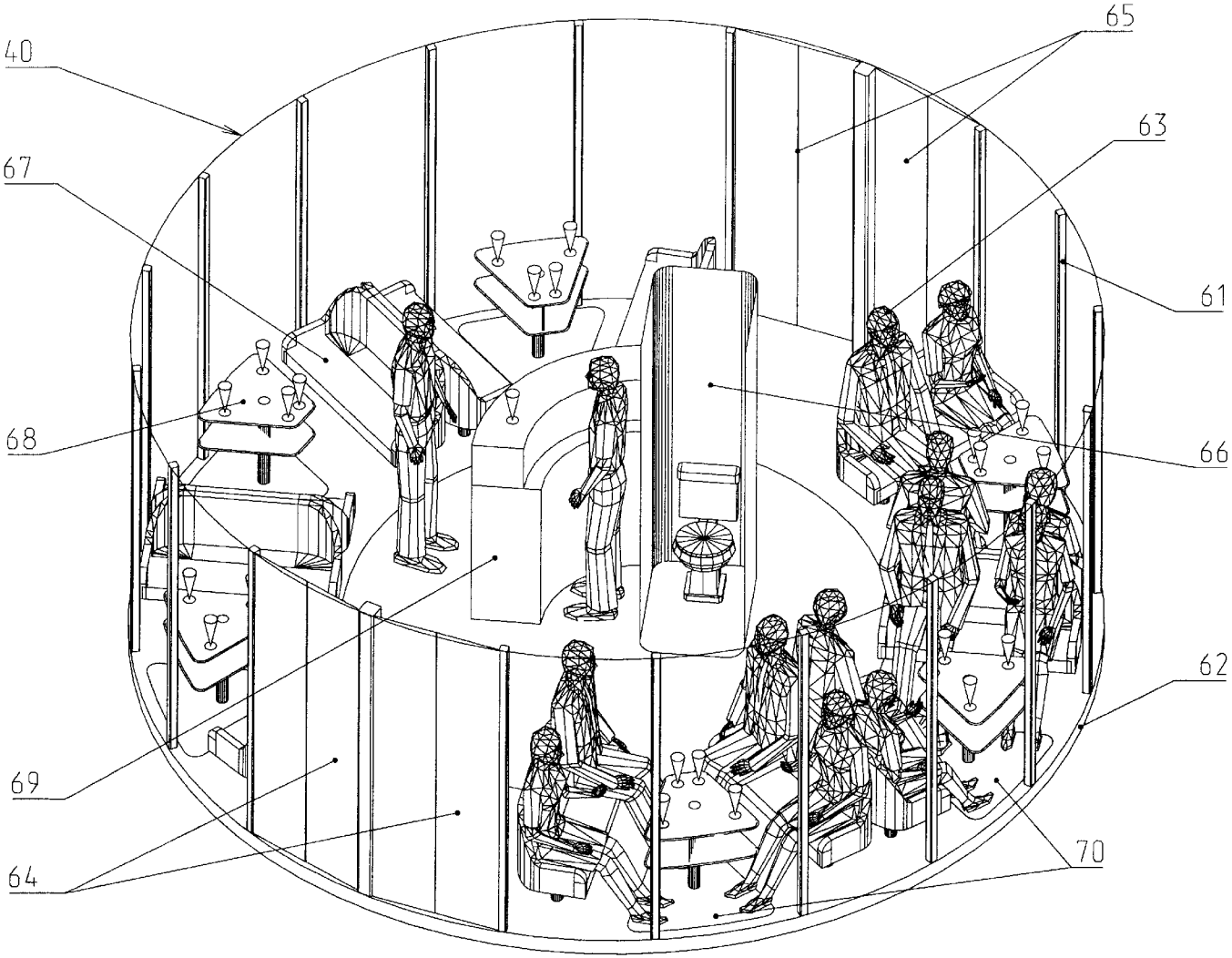
FIG. 6 is a diagrammatic perspective isometric view of one of the cabins in FIGS. 1–4.
Figure 11:
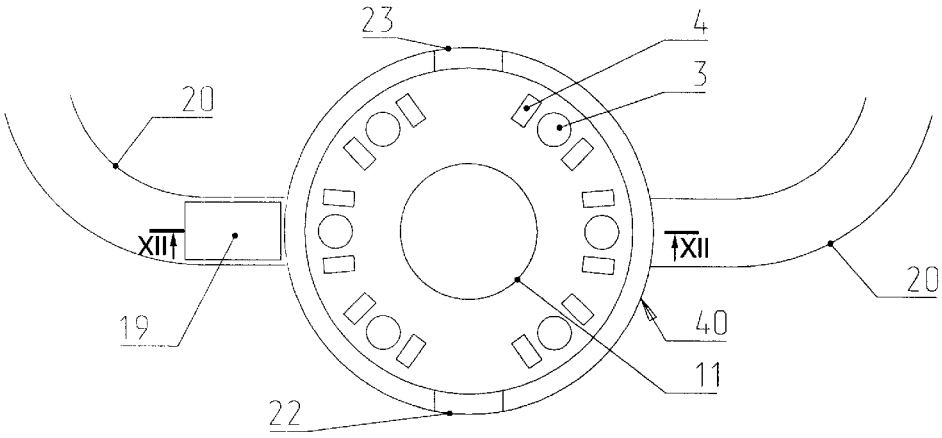
FIG. 11 is a top view of a cabin.
Figure 12:
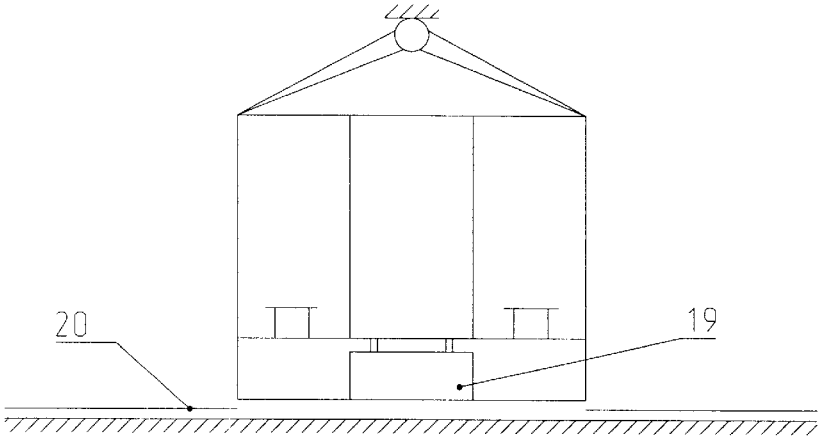
FIG. 12 is section view along line XII—XII in FIG. 11.
Figure 13:
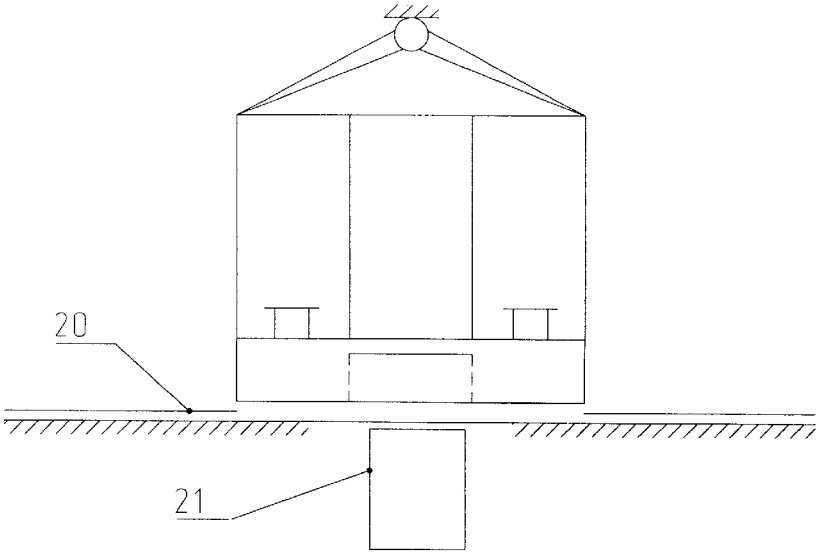
FIG. 13 is a diagrammatic view of a cabin when a capsule is used.

FIG. 6 illustrates an example of the amusement ride cabin 40 designed as a bar (or a restaurant). Said cabin 40 comprises: a body 61 having a base 62 in a lower part; an assembly suspending said body on to the amusement ride elements (not shown in FIG. 6), gates 64 (entrance doors) for loading passengers 63, gates 65 (exit doors) for unloading passengers 63; tables 68 mounted on said base 62, seats 67 positioned on said base 62 around tables 68, restaurant equipment elements mounted on base 62. The restaurant equipment elements include a working place 69 for serving personnel with elements of kitchen equipment for heating and/or cooling food (not shown in FIG. 6), and a toilet 66. The body 61 of the cabin 40 is at least partially made of transparent material. The base 62 may be rotatable relative to the body 61.

The base 62 is at least partially made of transparent material 70, e.g. transparent floor and/or wall panels. Each cabin-restaurant is mounted on a panoramic wheel (e.g., 140–200 m in diameter), may accommodate 28–32 passengers, and may have the following dimensions: diameter 6 m, height-3,2 m. The wheel can rotate continuously making one revolution per hour. Passengers can enter the cabins and leave them when the cabin is passing units 50 and 52 for passenger loading and unloading and for passenger servicing, respectively. At the same time food that has been cooked in advance may be loaded into the cabin. The food may be heated before it is served to clients. And different cabins, for example, may represent cuisines of various nations.

Versions of cabin 40 are shown in FIGS. 7–13.

For leisure, cabin 40 is designed with elements of a restaurant and/or a bar.

Figure 8:
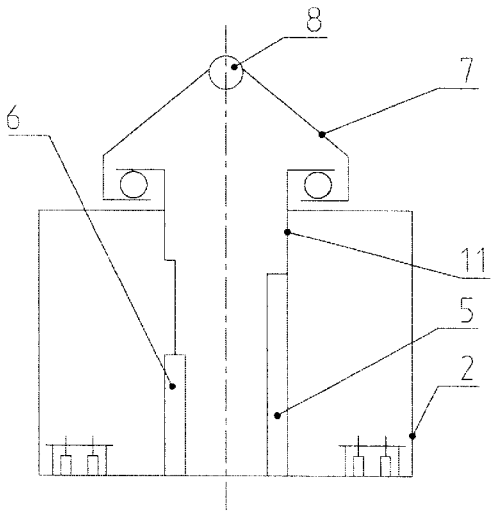
FIG. 8 shows a cabin whose platform is shaped as a circle.
Figure 9:
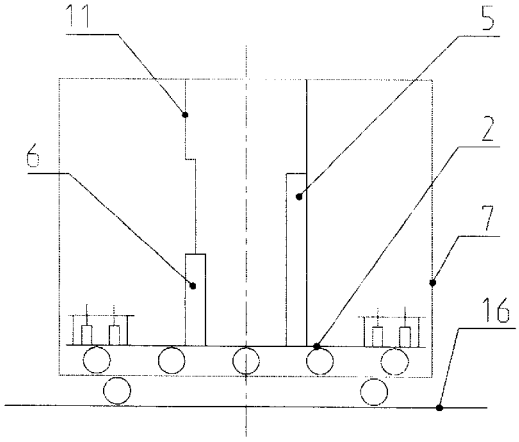
FIG. 9 shows a cabin in the form of a car wherein the rotating platform is shaped as a circle.
Figure 10:
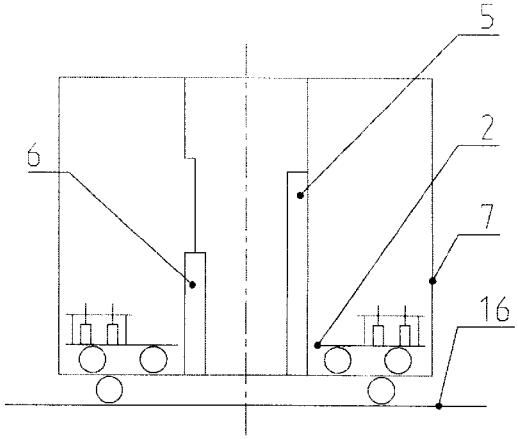
FIG. 10 shows the cabin of FIG. 7 with a circular platform.

The cabin comprises rotating platform 2 which can be shaped as a ring (FIGS. 7,10) or a circle (FIGS. 8, 9). The platform supports tables 3 and chairs 4.

Kitchen equipment elements 5 with working station 6 for the servicing personnel are positioned in the central part of the cabin and can be mounted either on platform 2 or on base 7.

If the cabin is suspended, the base can be designed as a suspension (FIG. 8), which is connected through hinge assembly 8 to support assembly 9 of driving wheel 10. In case of a different design, said connection with support assembly 9 can be implemented through hinge assembly 8 which can be directly connected to element 11 supporting the kitchen equipment elements and working station for the servicing personnel (FIG. 4).

In still another embodiment (not shown in the drawings) suspensions connected with the base and positioned between element 11 and the circular platform can be used to suspend the cabin.

If the cabin is designed like a car element 11, the kitchen equipment elements and working station for the servicing personnel can be located either on platform 2 or on base 7, with support functions being performed by the car frame.

The platform can be turned by a separate drive or the platform can be driven by mechanically interacting with a stationary element of the ride foundation or base.

It is desirable for the cabin to be equipped with an entire sanitary and engineering unit which contains kitchen equipment 5, and can include sink 17 and lavatory 18, waste bin 19 the delivery and removal of which can be facilitated by means of guides 20, capsule 21, door aperture 22 for passengers entering and leaving, and door aperture 23 for the delivery of food and accessories.

All the above mentioned embodiments of the invention operate similarly to the known devices in terms of overall movement of the cabins as an amusement ride and are distinguished by the multi-purpose design of their structure which makes it possible to implement a new cabin structure featuring elements of a restaurant and/or a bar and to erect the ride on a roof making use of the building height to create entertaining effects.

For passenger loading and unloading, part of the ride should be located within the upper part of the building. Said part is also required for the delivery of foodstuffs into the cabin.

The drive for the cabin motion can be quite versatile, and the rotating device can be turned by a separate drive or through the interaction of a stationary element with the rotating base platform of the cabin during its motion.

In the course of the cabin motion passengers enter through door aperture 22 and occupy vacant seats at the table. While passengers are loading, foodstuffs and necessary accessories are delivered through door aperture 23.

Foodstuffs and necessary accessories can be also delivered through the lower part of the cabin making use of capsule 21, for which purpose the displacement of said capsule and said cabin should be synchronized.

The waste collected in bins 19 is removed from the vehicle together with the bin. Bin 19 can also be removed after ride shut down upon completion of its operation or during scheduled maintenance.

Bin 19 when filled, can be replaced with an empty one in the course of the cabin motion using guides 20 with fixing elements on the side of the cabin motion direction (not shown in the drawings) and, possibly but not necessarily, with a device for displacing the filled bin on the opposite side.

Food can be prepared for guests both in servicing unit 24 positioned near the place of passenger loading/unloading and in the cabin itself (making simple dishes and drinks). Ready-made food and drinks can also be delivered for storage in the servicing unit and supply to the cabin.

In all embodiments the amusement rides operate so that the bases of the cabins 40 always are in a substantially horizontal (preferably horizontal) position during the ride operation.

While the invention has been particularly shown, described and illustrated in detail with reference to preferred embodiments and modifications thereof, it should be understood by those skilled in the art that the foregoing and other modifications are exemplary only, and that equivalent changes in form and detail may be made therein without departing from the true spirit and scope of the invention as claimed.

What is claimed is:

1. An amusement ride comprising:

a base;

stationary components mounted on said base;

assemblies that are mobile relative to said stationary components;

cabins that are fastened on said mobile assemblies; and units for loading, servicing and unloading passengers, said units being mounted on said base;

wherein at least one of said cabins is equipped as a restaurant and/or a bar, and the servicing units contain blocks for preparing and/or storing food;

wherein said servicing units include a waste bin; and wherein guides are mounted on said base for delivering said waste bin in an empty condition and removing said waste bin in a filled condition during motion of the cabins.

2. The amusement ride according to claim 1, wherein said at least one cabin contains tables, seats, elements of kitchen equipment, and a working station for servicing personnel.

3. The amusement ride according to claim 2, wherein:

said at least one cabin comprises a car and a rotatable platform provided in said car;

said platform comprises a central part and a circumferential part;

said tables and seats are positioned on the circumferential part of said platform; and the elements of kitchen equipment and the working station for the servicing personnel are positioned on the central part of said platform.

4. The amusement ride according to claim 2, wherein:

said at least one cabin comprises a base having a central part and a rotating platform surrounding said central part;

said tables and seats are positioned on the rotating platform; and the elements of kitchen equipment and the working station for the servicing personnel are positioned on the central part.

5. The amusement ride according to claim 1, wherein said at least one cabin includes a toilet.

6. An amusement ride comprising:

a base;

stationary components mounted on said base;

assemblies that are mobile relative to said stationary components;

cabins that are fastened on said mobile assemblies; and units for loading, servicing and unloading passengers, said units being mounted on said base;

wherein at least one of said cabins is equipped as a restaurant and/or a bar, and the servicing units contain blocks for preparing and/or storing food;

wherein said servicing units include a waste bin; and wherein said at least one cabin has a lower part, and a separate block is provided in the lower part of said at least one cabin for housing said waste bin.

7. The amusement ride according to claim 6, wherein said at least one cabin contains tables, seats, elements of kitchen equipment, and a working station for servicing personnel.

8. The amusement ride according to claim 7, wherein:

said at least one cabin comprises a car and a rotatable platform provided in said car;

said platform comprises a central part and a circumferential part;

said tables and seats are positioned on the circumferential part of said platform; and the elements of kitchen equipment and the working station for the servicing personnel are positioned on the central part of said platform.

9. The amusement ride according to claim 7, wherein:

said at least one cabin comprises a base having a central part and a rotating platform surrounding said central part;

said tables and seats are positioned on the rotating platform; and the elements of kitchen equipment and the working station for the servicing personnel are positioned on the central part.

10. The amusement ride according to claim 6, wherein said at least one cabin includes a toilet.

11. An amusement ride comprising:

a base;

stationary components mounted on said base;

assemblies that are mobile relative to said stationary components;

cabins that are fastened on said mobile assemblies; and units for loading, servicing and unloading passengers, said units being mounted on said base;

wherein at least one of said cabins is equipped as a restaurant and/or a bar, and the servicing units contain blocks for preparing and/or storing food;

wherein said stationary components and said assemblies that are mobile relative to said stationary components constitute a panoramic wheel;

wherein said panoramic wheel is continuously rotatable; and wherein said at least one cabin is provided with a separate door aperture for delivery of foodstuffs and accessories into said at least one cabin during motion of said at least one cabin.

12. The amusement ride according to claim 11, wherein said at least one cabin contains tables, seats, elements of kitchen equipment, and a working station for servicing personnel.

13. The amusement ride according to claim 12, wherein:

said at least one cabin comprises a car and a rotatable platform provided in said car;

said platform comprises a central part and a circumferential part;

said tables and seats are positioned on the circumferential part of said platform; and the elements of kitchen equipment and the working station for the servicing personnel are positioned on the central part of said platform.

14. The amusement ride according to claim 12, wherein:

said at least one cabin comprises a base having a central part and a rotating platform surrounding said central part;

said tables and seats are positioned on the rotating platform; and the elements of kitchen equipment and the working station for the servicing personnel are positioned on the central part.

15. The amusement ride according to claim 11, wherein said at least one cabin includes a toilet.

16. An amusement ride comprising:

a base;

stationary components mounted on said base;

assemblies that are mobile relative to said stationary components;

cabins that are fastened on said mobile assemblies; and units for loading, servicing and unloading passengers, said units being mounted on said base;

wherein at least one of said cabins is equipped as a restaurant and/or a bar, and the servicing units contain blocks for preparing and/or storing food;

wherein said stationary component comprises an axle directed upward from said base, and said mobile assemblies comprise a driving wheel; and wherein said base comprises a roof of a building.

17. The amusement ride according to claim 16, wherein said axle is located on said roof near a corner of said roof so that the cabins partially rotate outside said roof.

18. The amusement ride according to claim 16, wherein said axle is positioned at an angle relative to a plane of said roof.

19. The amusement ride according to claim 18, wherein said angle is changeable during operation of the amusement ride.

20. The amusement ride according to claim 16, wherein said at least one cabin contains tables, seats, elements of kitchen equipment, and a working station for servicing personnel.

21. The amusement ride according to claim 20, wherein:

said at least one cabin comprises a car and a rotatable platform provided in said car;

said platform comprises a central part and a circumferential part;

said tables and seats are positioned on the circumferential part of said platform; and the elements of kitchen equipment and the working station for the servicing personnel are positioned on the central part of said platform.

22. The amusement ride according to claim 20, wherein:

said at least one cabin comprises a base having a central part and a rotating platform surrounding said central part;

said tables and seats are positioned on the rotating platform; and the elements of kitchen equipment and the working station for the servicing personnel are positioned on the central part.

23. The amusement ride according to claim 16, wherein said at least one cabin includes a toilet.

* * * * *